US005419414A

United States Patent [19]

Sakita

[11] Patent Number: 5,419,414

[45] Date of Patent: May 30, 1995

[54] ELEVATOR SYSTEM WITH MULTIPLE CARS IN THE SAME HOISTWAY

[76] Inventor: Masami Sakita, 1259 El Camino Real #121, Menlo Park, Calif. 94025

[21] Appl. No.: 154,034

[22] Filed: Nov. 18, 1993

[51] Int. Cl.[6] ..... B66B 1/00

[52] U.S. Cl. ..... 187/391; 187/380; 187/249; 187/247

[58] Field of Search ..... 187/100, 104, 105, 112, 187/124, 128, 1 R, 113, 17, 7, 94, 16, 380, 382, 381, 384, 387, 393, 902, 247, 414, 249

[56] References Cited

U.S. PATENT DOCUMENTS

| | | | |
|---|---|---|---|
| Re. 18,095 | 6/1931 | Sprague | 187/16 |
| 1,458,881 | 6/1923 | Gromer . | |
| 1,805,227 | 5/1931 | Rugg | 187/16 |
| 1,837,643 | 12/1931 | Anderson | 187/16 |
| 1,859,483 | 5/1931 | Winslow | 187/16 |
| 1,896,776 | 2/1931 | James | 187/16 |
| 1,896,777 | 2/1933 | James | 187/16 |
| 1,911,834 | 5/1933 | Lindquist | 187/16 |
| 1,973,920 | 9/1934 | Wilson | 187/16 |
| 1,976,495 | 8/1934 | Halfvarson | 187/16 |
| 3,658,155 | 4/1972 | Salter | 187/16 |
| 4,015,835 | 4/1977 | Schumacher et al. | 267/124 |
| 4,582,173 | 4/1986 | Schroder | 187/29 R |
| 4,632,224 | 12/1986 | Nowak et al. | 187/29 R |
| 4,635,907 | 1/1987 | Bialy et al. | 267/8 R |
| 5,083,640 | 1/1992 | Tsuji | 187/127 |
| 5,107,962 | 4/1992 | Ekholm | 187/16 |
| 5,235,144 | 8/1993 | Matsui et al. | 187/112 |
| 5,288,956 | 2/1994 | Kadokura et al. | 187/112 |

*Primary Examiner*—Thomas M. Dougherty
*Assistant Examiner*—Robert Nappi
*Attorney, Agent, or Firm*—Victor R. Beckman

[57] ABSTRACT

An elevator system is shown that includes an elevator shaft (12) in building (10) and a plurality of elevator cars ($C_1$, $C_2$ and $C_3$) that are movable up and down within the shaft along vertical axis (20). The elevator cars are independently movable by drive motors ($D_1$, $D_2$ and $D_3$) attached to the cars through hoisting cables (24, 28 and 34). The motors are controlled by motor controllers ($MC_1$, $MC_2$ and $MC_3$) which, in turn are controlled by a computer (62) having as inputs service and destination requests, load weight and car location. Different operating modes are shown (FIGS. 5–8) including one in which serviced floors ($F_1$ through $F_{16}$) are serviced by no more than one elevator car at a time, and the cars travel sequentially from one end floor to the other end floor (FIGS. 5 and 6). Simultaneous servicing of a plurality of different floors is shown (FIGS. 7 and 8) and travel of empty elevator cars to a designated floor without responding to floor calls also is shown (FIGS. 6 and 8). Counterweights ($CW_1$, $CW_2$ and $CW_3$) are attached by cables to the respective elevator cars ($C_1$, $C_2$ and $C_3$), which counterweights travel along a vertical axis (38) laterally displaced from the elevator car axis (20). Shock absorbers (54) are provided for absorbing impact of accidental collision between adjacent counterweights (FIG. 3 ) which shock absorbers include coil springs (58) and dashpots (60).

4 Claims, 8 Drawing Sheets

ELEVATOR SYSTEM WITH MULTIPLE CARS IN THE SAME HOISTWAY

BACKGROUND OF THE INVENTION

1. Field of the Invention

This invention relates generally to a multicar elevator system having an elevator shaft within which a plurality of independently movable elevator cars operate.

2. Description of the Related Art

In tall buildings, and particularly in tall narrow buildings, a significant portion of floor space is required for elevators. With conventional elevator systems, one elevator car operates in each vertical elevator shaft. One prior art method of reducing the amount of floor space required for such conventional elevator systems includes the use of double-deck elevator cars whereby each elevator shaft contains two attached elevator cars. Such arrangements are shown, for example, in U.S. Pat. Nos. 4,582,173 and 4,632,224. Since the two cars move as a unit, operation thereof is very restricted since only adjacent floors may be simultaneously serviced by the cars. For example, two lobby landings may be employed whereby passengers destined for odd numbered floors must use one lobby and those destined for even numbered floors must use the other lobby. Also, drive motors, hoisting cables, and the like, used to raise and lower the double-deck cars must be of greater power and strength than those needed for use with conventional single elevator cars. Another prior art method of reducing the amount of floor space required for elevators includes use of a pair of elevator shafts in which elevator cars ascend in one shaft and descend in the other. The elevator cars move between elevator shafts adjacent the top and bottom of the vertical elevator shafts. In one such arrangement shown in U.S. Pat. No. 1,458,881, the elevator cars are moved vertically by use of endless chains that extend along the vertical shafts. In U.S. Pat. No. 3,658,155 , a plurality of self-propelled elevator cars are provided which are adapted to travel up one elevator shaft and down another. Each elevator car carries a drive motor connected to a drive member engagable with guide means extending along the elevator shafts and between elevator shafts at the top and bottom of the vertical shafts. The elevator cars are movable laterally from the vertical shafts at any floor for loading and unloading. Since travel is limited to movement in one direction in the two vertical shafts, benefits derived from such arrangements over conventional elevator systems are limited.

SUMMARY OF THE INVENTION

In accordance with the present invention an elevator system for a multistory structure having a plurality of floors is provided which includes a vertical elevator shaft defining a vertical pathway extending past a plurality of floors of the structure. A plurality of independently operated elevator cars are located in the vertical elevator shaft for movement solely along a vertical axis within the elevator shaft for servicing a plurality of serviced floors including a lower end floor, an upper end floor, and a plurality of intermediate floors between said end floors. Drive motors are provided which are connected by drive ropes, or hoisting cables, to the elevator for moving the cars in both up and down directions within the elevator shaft along the vertical axis. A counterweight is provided for each elevator car for counterbalancing weight of the elevator cars, which counterweights may be connected to the elevator cars through the hoisting cables. The counterweights are movable along a second vertical axis in said elevator shaft parallel to said first vertical axis. Shock absorbing means are provided between adjacent counterweights for absorbing the impact of accidental collision between adjacent counterweights. The shock absorbing means may comprise, for example, coil springs and dash-pots, which dash-pots are operable after partial compression of the coil springs. An elevator control system which includes signal processing means such as a digital computer is used in the production of control signals for controlling the elevator cars. The control system includes floor call means at floors of the structure for registering up and down service requests for an elevator, car call means at each elevator for registering destination requests to floors of the structure, position sensing means for sensing the position of each elevator car within the elevator shaft, and load weight sensing means for sensing weight carried by the elevator cars. The elevator cars are operable in a variety of different operating modes which may depend upon existing demand for service. In one operating mode the elevator cars operate along different portions of the elevator shaft for servicing different floors of the building, and in another operating mode each elevator car services all of the serviced floors. Where each car services all of the serviced floors, the system may be operated such that only one elevator car is under service operation at a time. Under operation of control signals from the digital computer, elevator cars may be controlled to sequentially travel from one end floor to the other. For example, as soon as one elevator car reaches the upper end floor, the next car is dispatched from the lower end floor until all elevator cars have reached the upper end floor. Similar sequential operation during descent of the elevator cars may be provided. Alternatively, the system may be operated so as to allow for simultaneous servicing of a plurality of serviced floors by a plurality of the elevator cars. With this operation, the elevator cars may be limited to travel in the same direction until all of the elevator cars have reached one of the end floors at which time the direction of travel is reversed. Alternatively, the system may be operated in such a manner that elevator cars can reverse direction of travel so long as safety is guaranteed. For example, if three elevator cars are included in one elevator shaft, and they are all traveling in one direction, the trailing elevator car may be allowed to reverse direction of travel. Additionally, an empty elevator car may be sent to a designated floor without responding to service requests on the way. With the present elevator system a large saving of floor space required for elevator service of a building is provided.

The invention together with other features and advantages thereof will be more fully understood from a consideration of the following detailed description thereof taken in connection with the accompanying drawings. It here will be understood that the drawings are for purposes of illustration only, the invention not being limited to the specific embodiments disclosed herein.

BRIEF DESCRIPTION OF THE DRAWINGS

In the drawings, wherein like reference characters refer to the same parts in the several views.

DETAILED DESCRIPTION OF THE INVENTION

Figure 1:
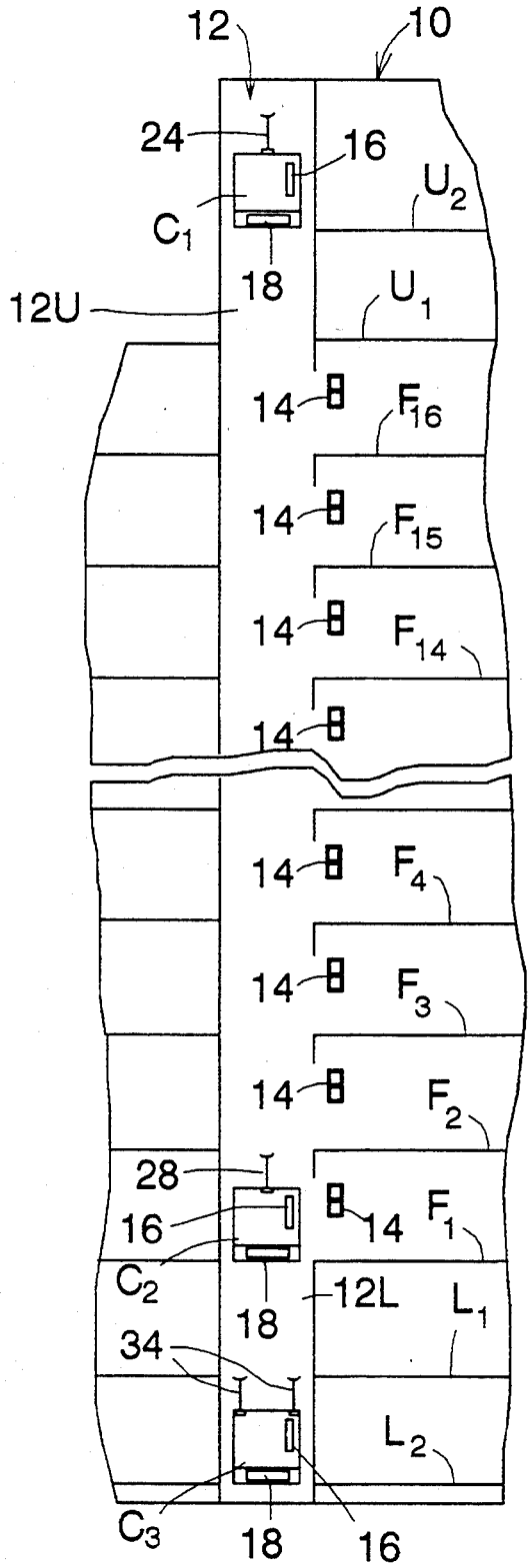
FIG. 1 is a fragmentary diagrammatic elevational view of a multistory structure having an elevator system that embodies the present invention.

Reference first is made to FIG. 1 of the drawings wherein a multistory building structure 10 is shown which includes a vertical elevator shaft 12 within which a plurality of independently operated elevator cars $C_1$ through $C_N$ operate, where N is on integer greater than 1. For purposes of illustration only, and not by way of limitation, three elevator cars $C_1$, $C_2$, and $C_3$ are shown. In the illustrated system, each car is adapted to serve the same landings, or floors, of the building which, for example, comprise floors $F_1$ through $F_{16}$. These floors, which are adapted to be serviced by all of the elevator cars, are identified herein as serviced floors, and floors $F_1$ and $F_{16}$ are identified as lower and upper end floors, respectively. It will be noted that elevator shaft 12 extends beneath lower end floor $F_1$ and above upper end floor $F_{16}$ to provide for lower and upper car storage areas 12L and 12U, respectively. Cars $C_2$ and $C_3$ beneath uppermost car $C_1$ are adapted for storage at lower storage areas 12L, and cars $C_1$ and $C_2$ above lowermost car $C_3$ are adapted for storage at upper storage area 12U. The structure is shown to include floors $L_1$ and $L_2$ adjacent lower storage area 12L, and floors $U_1$ and $U_2$ adjacent upper storage area 12U.

Floor call means 14 are located at floors of the building for registering up and down service requests for an elevator car. Also, each car includes car call means comprising a car operating panel 16 having car call buttons by means of which passengers enter destination requests to one of the serviced floors of the building. Load weight sensing means 18 are carried by each car to provide load weight information signals dependent upon the load on the car floors. Also, the system includes position sensing means for production of car position information signals dependent upon the position of the cars within the elevator shaft. Floor call means, car call means, load weight sensing means and position sensing means for production of service requests, destination requests, load weight and position signals for use in the present invention are all well known in the elevator art, including above-mentioned U.S. Pat. No. 4,632,224, and require no additional description.

Figure 2:
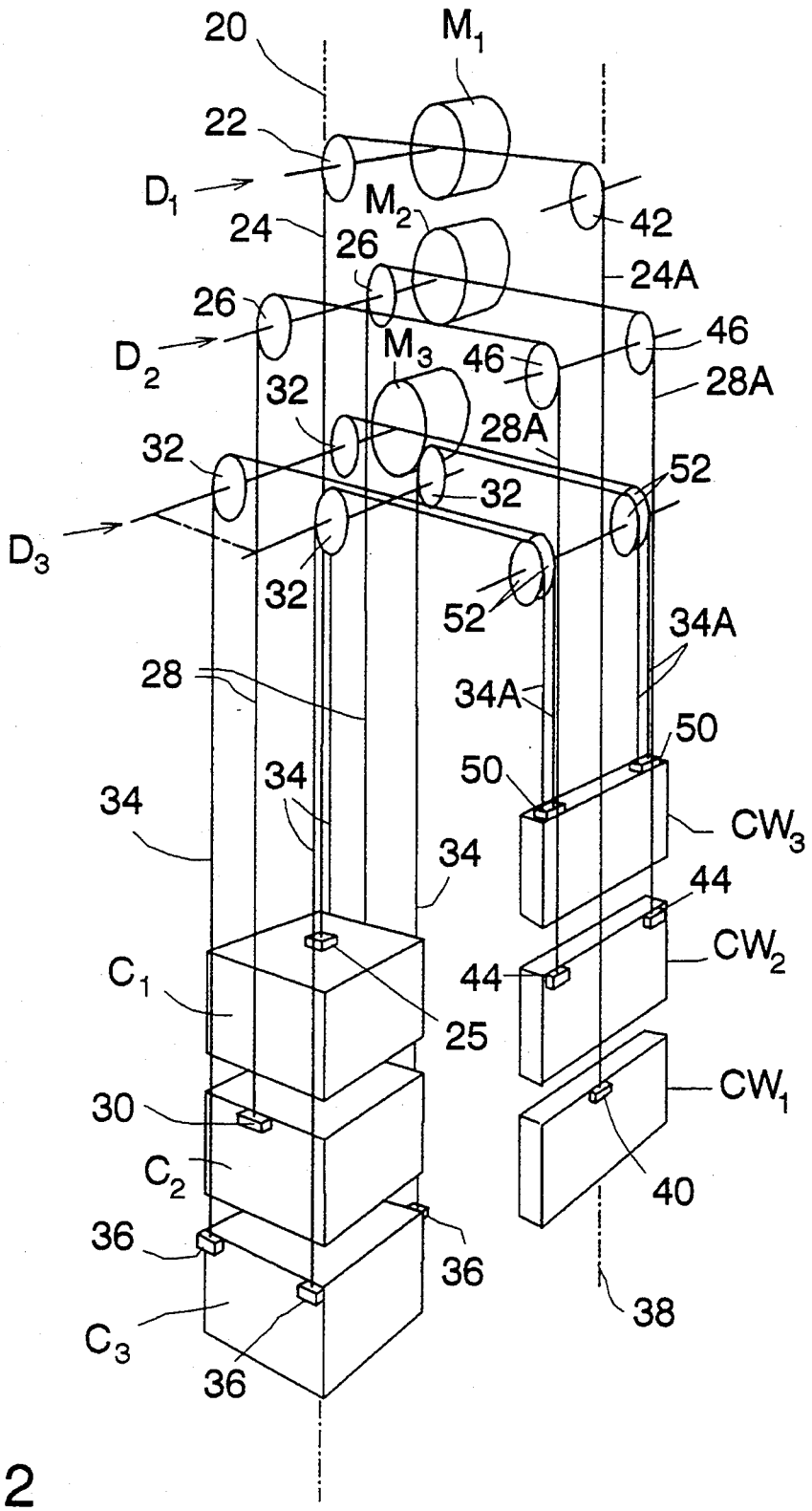
FIG. 2 is a simplified diagrammatic perspective view of the elevator system shown in FIG. 1.

Reference now is made to FIG. 2 wherein the elevator cars $C_1$, $C_2$ and $C_3$ are shown together with associated drive means $D_1$, $D_2$ and $D_3$ comprising motors $M_1$, $M_2$ and $M_3$ for moving the cars up and down within the elevator shaft along a first vertical axis 20. Motor $M_1$ is connected to a drive sheave, or wheel, 22 around which car drive ropes, or hoisting cables, 24 are wound (one of which is shown in the drawings), which drive ropes are attached as by attachment lugs 25 to elevator car $C_1$. Motor $M_2$ is connected to drive sheaves, or wheels, 26 around which car drive ropes, or hoisting cables, 28 are wound, which drive ropes are attached to elevator car $C_2$. Drive ropes 28 extend past elevator car $C_1$ and are affixed to car $C_2$ as by means of attachment lugs 30 attached to car $C_2$, one of which lugs is seen in FIG. 2. Motor $M_3$ is connected to drive sheaves, or wheels, 32 around which drive ropes, or hoisting cables, 34 are wound, which drive ropes are affixed to car $C_3$. Drive ropes 34 extend past both elevator cars $C_1$ and $C_2$ and are affixed to car $C_3$ as by means of attachment lugs 36 attached to car $C_3$, three of which are seen in FIG. 2. Guide means, not shown, guide the elevator cars for movement along vertical axis 20 upon operation of the associated motors.

Each elevator car $C_1$ through $C_N$ is provided with an associated counterweight $CW_1$ through $CW_N$, which counterweights are suspended within the elevator shaft at a laterally spaced distance from the cars. Guide means not shown, guide the counterweights for movement along a vertical axis 38 a parallel spaced distance from vertical axis 20 along which the elevator cars travel. The counterweights are arranged in order opposite that of the elevator cars so that counterweight $CW_3$ is uppermost and counterweight $CW_1$ is lowermost. For purposes of illustration, the counterweights $CW_1$, $CW_2$ and $CW_3$ are shown connected to the elevator cars $C_1$, $C_2$ and $C_3$ through the respective drive ropes, or hoisting cables, 24, 28 and 34. Counterweight $CW_1$ is supported by ropes, or cables, 24A (one of which is shown in FIG. 2) affixed to the counterweight by attachment lug 40, which ropes pass over idler wheel 42 and are wound on drive sheave 22. Counterweight $CW_2$ is supported by ropes, or cables, 28A affixed to the counterweight by attachment lugs 44, which ropes pass over idler wheels 46 and are wound on drive sheaves 26. Finally, counterweight $CW_3$ is supported by ropes, or cables, 34A affixed to the counterweight by attachment lugs 50, which ropes pass over idler wheels 52 and are wound on drive sheaves 32. Obviously, ropes 24A, 28A and 34A for support of counterweights $CW_1$, $CW_2$ and $CW_3$ could be connected to elevator cars $C_1$, $C_2$ and $C_3$ through means other than the hoisting ropes and drive sheaves, as shown.

Figure 3:
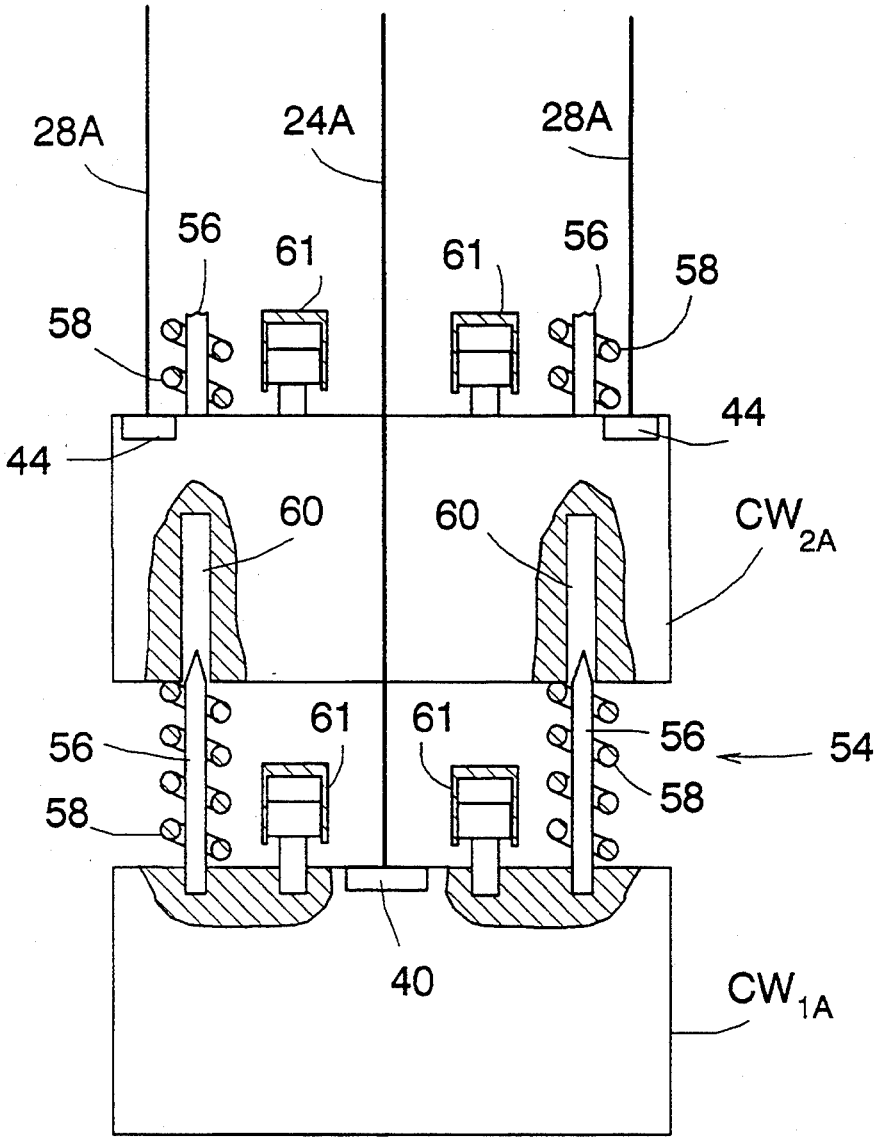
FIG. 3 is a diagrammatic view of two adjacent counterweights with shock absorbing means of this invention therebetween.

Reference now is made to FIG. 3 wherein counterweights $CW_{1A}$ and $CW_{2A}$ are shown which include shock absorbing means 54 for absorbing the impact of accidental collision therebetween, and which may be used in place of counterweights $CW_1$ and $CW_2$ shown in FIG. 2. Counterweights $CW_{1A}$ and $CW_{2A}$ are connected to elevator cars $C_1$ and $C_2$ through cables 24A and 28A in the manner shown in FIG. 2 and described above whereby the shock absorbing function extends to the associated elevator cars. The shock absorbing means includes a pair of vertical rods 56 attached to the counterweights and extending upwardly therefrom for support of coil springs 58. Counterweights located above those carrying coil springs 58 are formed with guide holes 60 which are entered by rods 56 in the event of a malfunction of a type that allows adjacent counterweights to move too close together. In such an event, coil springs 58 are compressed to absorb shock of inadvertent collision. Dashpots 61 having fixed position pistons and movable cylinders are affixed to the upper faces of counterweights. After partial compression of the springs, the dashpots engage the adjacent counterweight to further cushion shock of collision. The relative length of cables supporting the counterweights is selected to allow for operation of the shock absorbing means in a manner such that inadvertent collision of adjacent elevator cars is avoided. Under normal operating conditions the counterweights remain a sufficiently spaced distance apart so as to avoid operation of the shock absorbing means.

Figure 4:
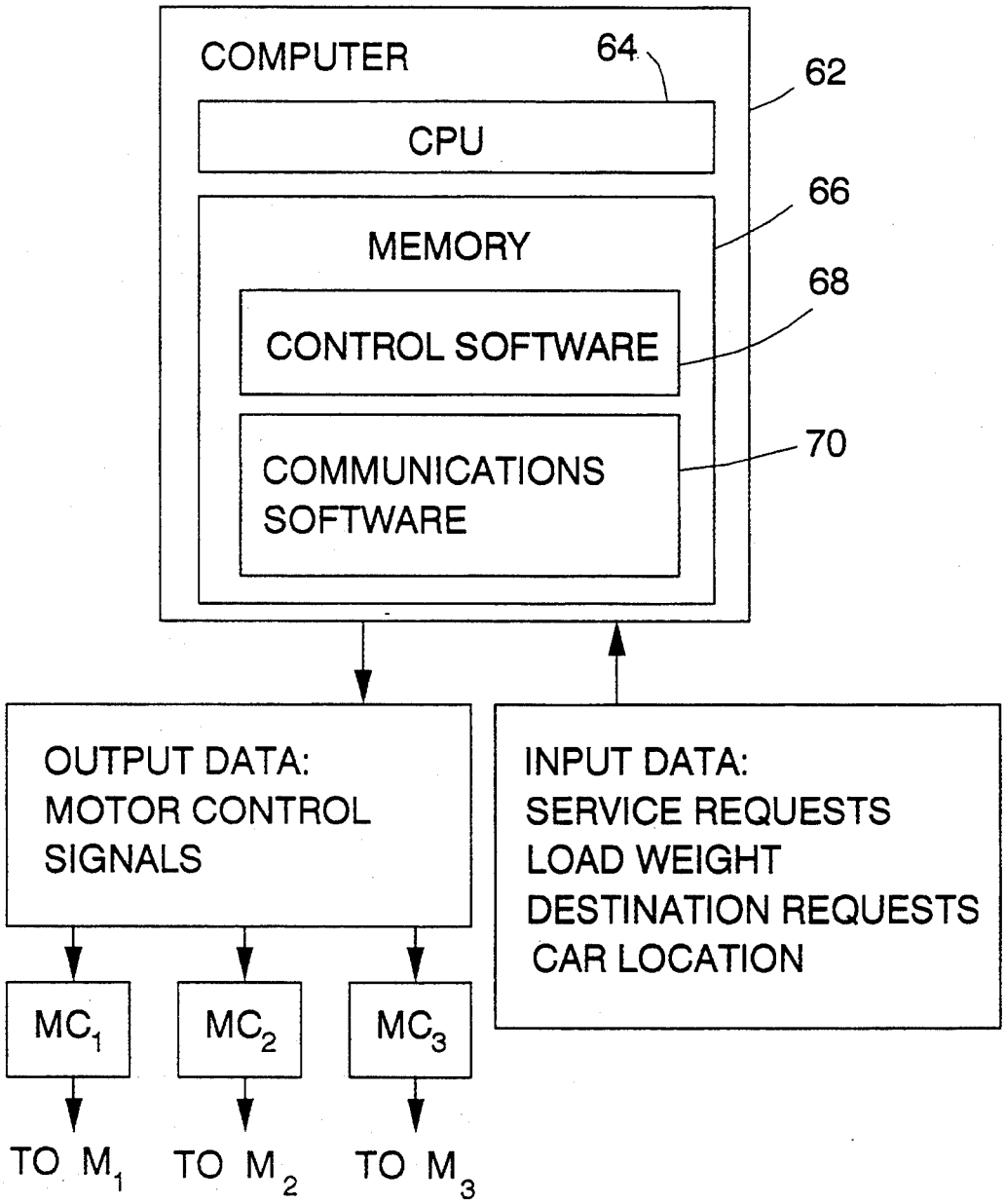
FIG. 4 is a block diagram showing a digital computer for controlling elevator cars of the present invention.

Reference now is made to FIG. 4 wherein a simplified block diagram of control means for control of motors $M_1$, $M_2$ and $M_3$ is shown comprising a computer 62, such as a microcomputer, which includes a central processing unit 64 and memory 66 with control software 68 and communications software 70. Input data to the computer include service requests from floor call means 14, load weight from weight sensing means 18, destination requests from car call means 16, and car location information for each of the elevator cars. Output data from the computer comprising motor stop and start control signals are supplied to motor control units $MC_1$, $MC_2$ and $MC_3$ connected to motors $M_1$, $M_2$ and $M_3$, respectively, for control of the motors.

Under control of computer 62, many different methods for operating the novel elevator system of this invention are possible, several of which are illustrated in FIGS. 5–8 of the drawings. In these drawings locations of the elevator cars $C_1$, $C_2$ and $C_3$ over successive time intervals are shown. Elevator cars not in service during a particular time interval are marked by an X therethrough. In the illustrated operating modes, all elevator cars are adapted for servicing all of the serviced floors $F_1$-$F_{16}$ of the building. In the operating mode illustrated in FIG. 5, only one elevator car at a time is in service operation, and the cars sequentially travel from one end floor to the other end floor. For example, between times $T_O$ and $T_1$, only car $C_1$ is adapted for servicing "up" floor and car calls. Cars $C_2$ and $C_3$ are out of service during this time period as indicated by the X therethrough. When car $C_1$ has passed upper end floor $F_{16}$, car $C_2$ is made available for servicing the "up" calls as shown between times $T_1$ and $T_2$, during which time cars $C_1$ and $C_3$ remain out of service. Between times $T_2$ and $T_3$, car $C_3$ travels between lower and upper end floors $F_1$ and $F_{16}$, and is the only car available for servicing "up" calls during this time period. Between times $T_O$ and $T_3$, no "down" calls are serviced by any of the cars, and servicing of "down" calls does not begin until all cars have reached top end floor $F_{16}$. "Down" calls are serviced between times $T_3$ and $T_6$ in a manner similar to that described above for the servicing of "up" calls. So long as any "up" or "down" service call is present which can not be serviced by the operative elevator car, the operative car travels in the current direction of travel to an end floor under control of computer 62.

Figure 5:
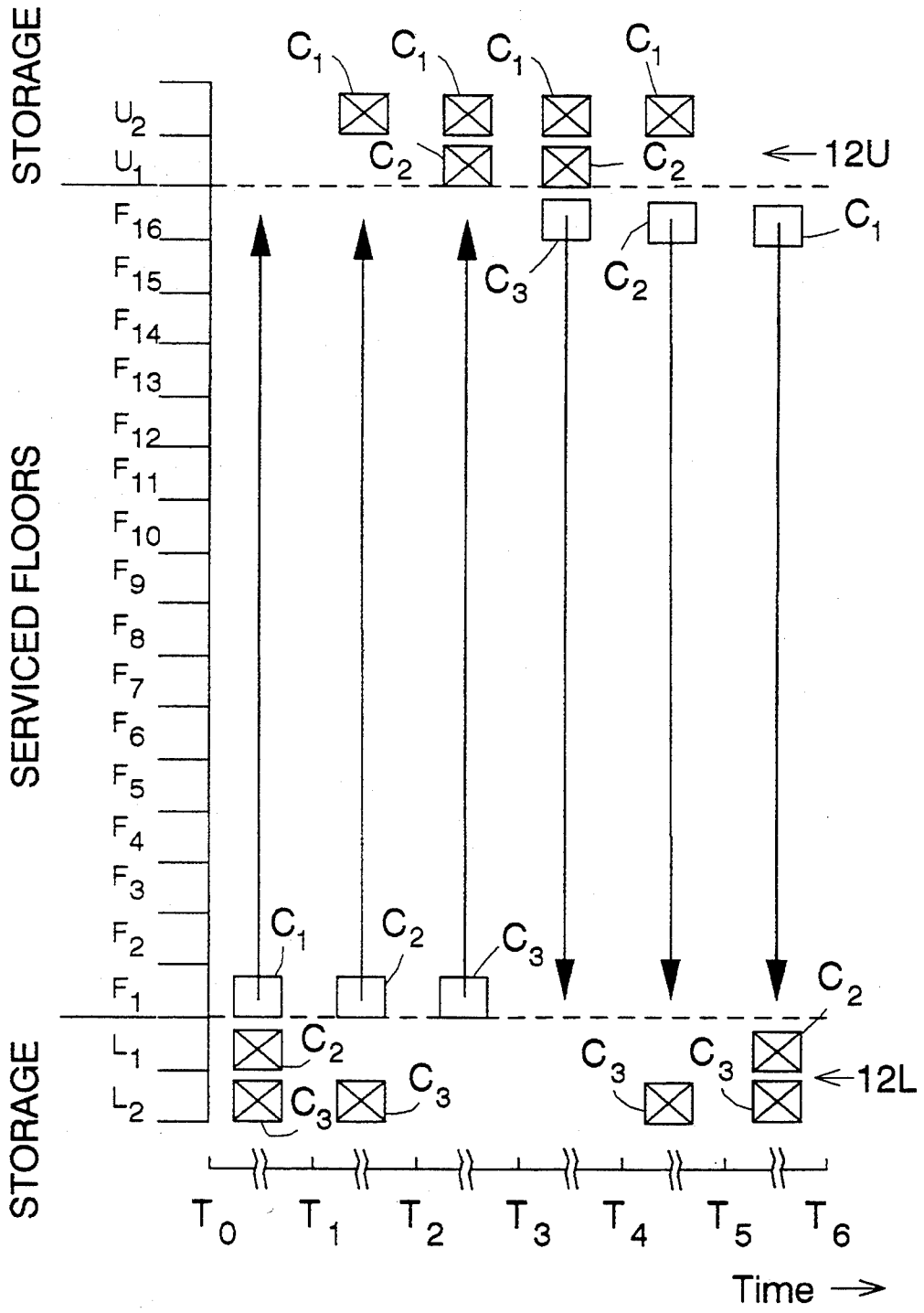
FIGS. 5–8 are elevator location versus time diagrams for use in illustrating different operating modes of the elevator system of this invention.
Figure 6:
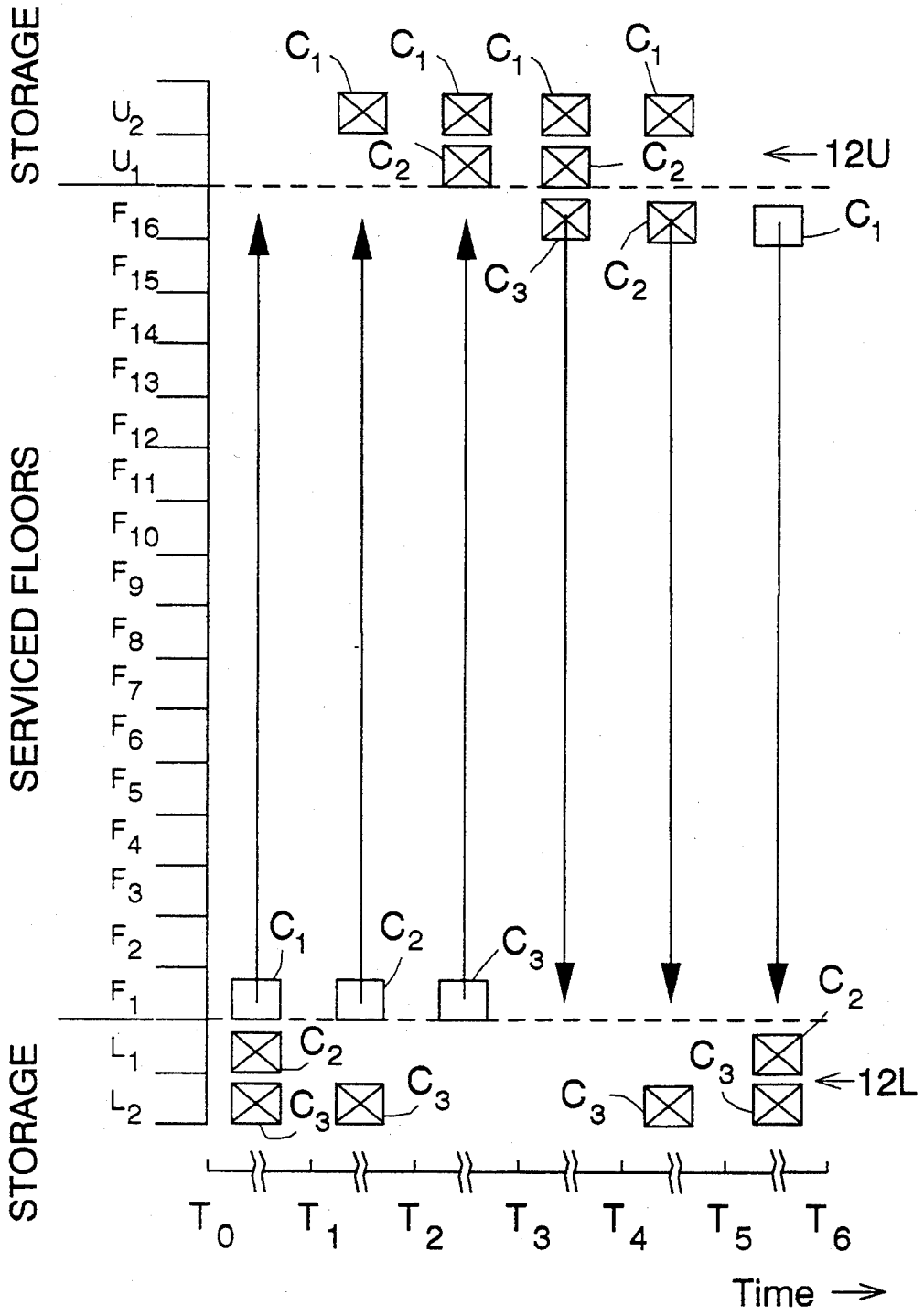

Reference now is made to FIG. 6 wherein operation of the system in a manner similar to that of FIG. 5 is shown except that in the FIG. 6 operation empty cars may be sent to a designated floor without responding to service requests from floor call means. As in the FIG. 5 operation, the cars sequentially travel from one end floor to the other end floor. In FIG. 6, between times $T_3$ and $T_4$, if car $C_3$ contains no passengers, it may be directed under computer control to descend from upper end floor $F_{16}$ to lower storage level 12L without stopping for service requests from floor call means. As noted above, an X mark within a car indicates that it is out of service. Here, all cars including car $C_3$, are shown to be out of service between times $T_3$ and $T_4$ while car $C_3$ descends from the upper end floor to the lower end floor. Similarly, car $C_2$, if empty, may be sent to a designated floor, such as floor $L_1$ of lower storage area 12L, without responding to "down" service requests that may be present on the way down. In the time period between $T_5$ and $T_6$, car $C_1$ responds to "down" service and destination requests. With this operating mode, system response time may be decreased under conditions where "up" calls greatly exceed "down" calls during, say, the morning rush hour. It here will be noted that similar "non-stop" descent of elevator cars $C_3$ and $C_2$ is shown in FIG. 8 between times $T_3$ and $T_5$.

Figure 7:
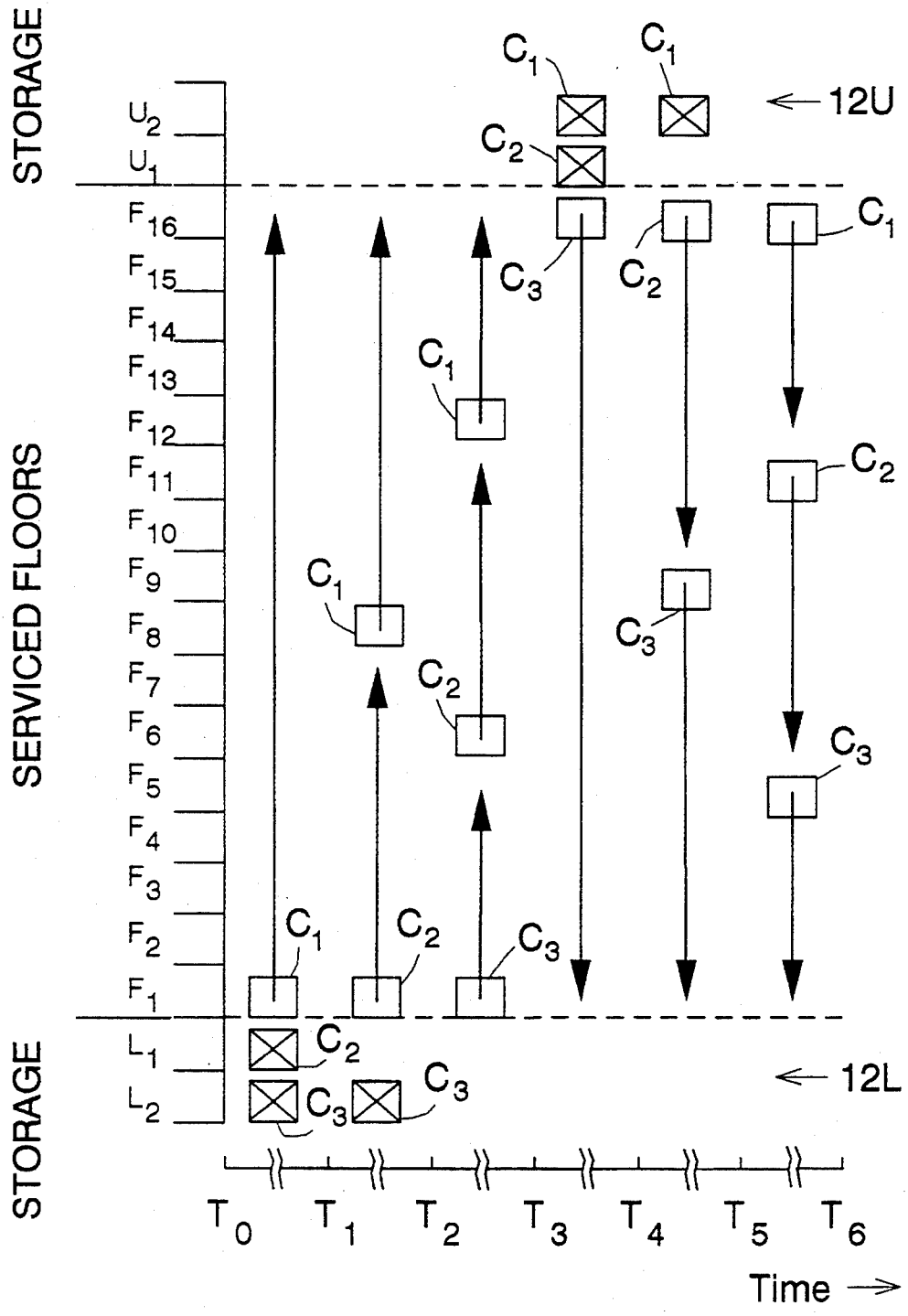

Reference now is made to FIG. 7 wherein system operation that provides for simultaneous travel of the cars in the same direction is shown. As in the operating modes illustrated in FIGS. 5 and 6, all elevator cars must travel to one end floor before direction of travel is reversed. As seen in FIG. 7, between times $T_O$ and $T_1$ car $C_1$ is available for servicing "up" calls. Between times $T_1$ and $T_2$, both cars $C_1$ and $C_2$ are available, and between times $T_2$ and $T_3$, all three cars $C_1$, $C_2$and $C_3$ are available for servicing "up" calls. When all of the cars have reached upper end floor $F_{16}$, "down" calls are serviced between times $T_3$ and $T_6$ in the same manner that "up" calls were serviced between times $T_O$ and $T_3$. In another operating mode not illustrated in the drawings, not only is simultaneous travel of elevator cars provided for, but cars may simultaneously travel in opposite directions so long as safety is guaranteed. For example, if three cars are implemented in a single shaft, as illustrated, and all are traveling upward, the lowermost car may be allowed to reverse its direction of travel while the upper two cars continue travel in the upward direction. As with other operating modes, travel is controlled by computer 62.

Figure 8:
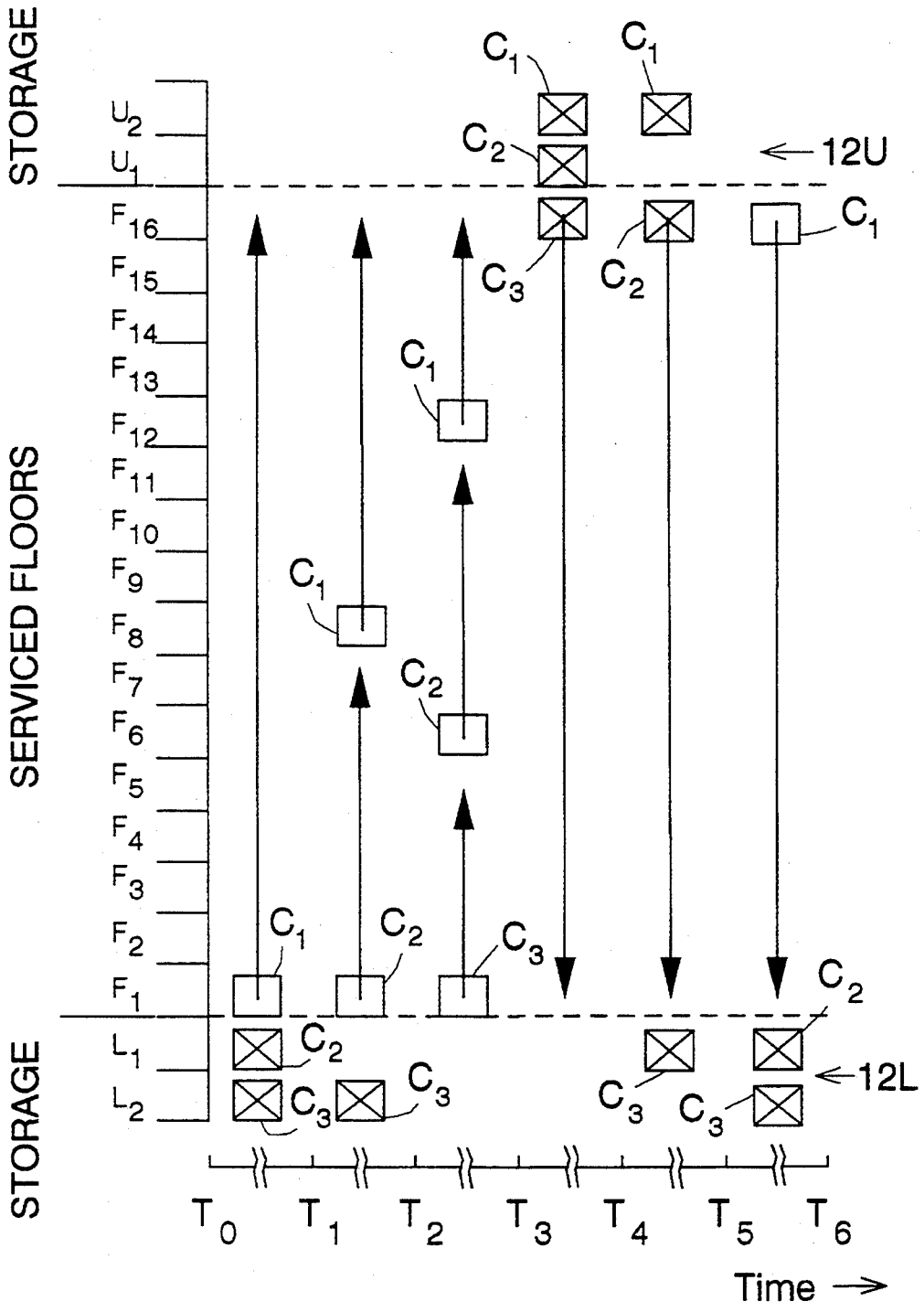

In FIG. 8, to which reference now is made, an operating mode that is a combination of those illustrated in FIGS. 6 and 7 is shown. There, between times $T_O$ and $T_3$, simultaneous travel of the cars in the same upward direction is allowed, as described above with reference to FIG. 7, and between times $T_3$ and $T_6$ operation wherein empty cars $C_3$ and $C_2$ travel from upper end floor $F_{16}$ to lower end floor $F_1$ without responding to service requests is shown, as described above with reference to FIG. 6.

The invention having been described in detail in accordance with requirements of the Patent Statutes, various changes and modifications will suggest themselves to those skilled in this art. As noted above, the invention is not limited to use with three elevator cars per shaft as illustrated. The use of two or more vertically aligned elevator cars movable up and down in a single shaft is contemplated. Also, cables for support of counterweights may be connected to the elevator cars by means other than through the hoisting cables, as shown. If desired, counterweights that are not axially aligned could be employed. For example, they may be laterally spaced apart from each other, including locations at different sides of the elevator cars. However, operation of the counterweights along a common vertical axis, as shown, helps to minimize space required for the elevator system. Obviously, the illustrated elevator system may be included in a bank of elevators, including elevators of the type shown herein and with known types of elevators. It will be readily apparent that the elevator system of this invention is not limited to operation in the above-described operating modes. Different operating modes, including different combinations of modes may be employed. As noted above, operation wherein each car services designated floors is contemplated. For example, where three elevator cars are employed, the upper car may serve the top one third of the building, the middle car may serve the middle one third, and lower car may serve the bottom one third. Obviously, the operating mode may change with time and/or in accordance with current demand for service. Also, operation that is coordinated with that of elevator cars in other elevator shafts in the building is contemplated. It is intended that the above and other such changes and modifications shall fall within the spirit and scope of the invention as defined in the appended claims.

I claim:

1. An elevator system for a multistory structure having a plurality of floors comprising:

a vertical elevator shaft defining a vertical pathway extending past a plurality of floors of the structure, a plurality of independently operated elevator cars $C_1$ through $C_N$ in said shaft where N is an integer greater than 1, each said elevator car being movable along a vertical axis in said shaft for servicing a plurality of serviced floors including a lower end floor, an upper end floor, and a plurality of intermediate floors between said end floors, a plurality of drive means $D_1$ through $D_N$ above the upper end floor connected by drive ropes to respective elevator cars $C_1$ through $C_N$ for moving said elevator cars in both up and down directions within said shaft along the vertical axis, an elevator control system comprising signal processing means including a digital computer for controlling said elevator cars, floor call means at floors of said structure for registering up and down service requests for an elevator car, car call means at each elevator car for registering destination requests to floors of said structure, means for sensing the position of each car within said shaft, means for supplying service requests, destination requests, and car position information to said signal processing means from said respective floor call means, car call means and position sensing means for use by said signal processing means in production of control signals for control of said drive means, wherein all of said serviced floors are serviced by each of said elevator cars, wherein control signals produced by said signal processing means limit servicing of the serviced floors such that no more than one of said elevator cars is servicing the serviced floors at one time, and wherein the elevator cars sequentially travel from one end floor to the other end floor under control of said control signals.

2. An elevator system as defined in claim 1 including a storage area above the upper end floor and a storage area below the lower end floor for storage of at least N-1 elevator cars at each storage area.

3. An elevator system for a multistory structure having a plurality of floors comprising:

a vertical elevator shaft defining a vertical pathway extending past a plurality of floors of the structure, a plurality of independently operated elevator cars $C_1$ through $C_N$ in said shaft where N is an integer greater than 1, each said elevator car being movable along a vertical axis in said shaft for servicing a plurality of serviced floors including a lower end floor, an upper end floor, and a plurality of intermediate floors between said end floors, a plurality of drive means $D_1$ through $D_N$ above the upper end floor connected by drive ropes to respective elevator cars $C_1$ through $C_N$ for moving said elevator cars in both up and down directions within said shaft along the vertical axis, an elevator control system comprising signal processing means including a digital computer for controlling said elevator cars, floor call means at floors of said structure for registering up and down service requests for an elevator car, car call means at each elevator car for registering destination requests to floors of said structure, means for sensing the position of each car within said shaft, means for supplying service requests, destination requests, and car position information to said signal processing means from said respective floor call means, car call means and position sensing means for use by said signal processing means in production of control signals for control of said drive means, wherein all said serviced floors are serviced by each of said elevator cars, wherein control signals produced by said signal processing means provide for simultaneous servicing of a plurality of the serviced floors by a plurality of said elevator cars, and wherein the elevator cars are limited to travel in the same direction until all elevator cars have reached one of said end floors at which time the direction of travel of all elevator cars is reversed under control of said control signals.

4. An elevator system as defined in claim 3 including a storage area above the upper end floor and a storage area below the lower end floor for storage of at least N-1 elevator cars at each storage area.

* * * * *